United States Patent [19]

Kato et al.

[11] Patent Number: 4,828,952

[45] Date of Patent: May 9, 1989

[54] ELECTROPHOTOGRAPHIC LITHOGRAPHIC PRINTING PLATE PRECURSOR

[75] Inventors: Eiichi Kato; Kazuo Ishii; Ryosuke Itakura; Hidefumi Sera, all of Shizuoka, Japan

[73] Assignee: Fuji Photo Film Co., Ltd., Kanagawa, Japan

[21] Appl. No.: 45,998

[22] Filed: May 4, 1987

[30] Foreign Application Priority Data

May 2, 1986 [JP] Japan ..... 61-100996

[51] Int. Cl.[4] ..... G03G 5/087

[52] U.S. Cl. ..... 430/87; 430/96

[58] Field of Search ..... 430/96, 87

[56] References Cited

U.S. PATENT DOCUMENTS

| | | | |
|---|---|---|---|
| 17,408 | 2/1970 | Kato et al. . | |
| 3,121,006 | 11/1969 | Middleton et al. . | |
| 3,445,224 | 5/1969 | Bach et al. . | |
| 3,533,787 | 10/1977 | Merrill et al. . | |
| 3,709,684 | 1/1973 | Feltzin | 430/87 X |
| 3,776,724 | 3/1971 | Usamani . | |
| 3,799,911 | 3/1974 | Dissen | 430/87 X |
| 3,912,506 | 12/1980 | Merrill . | |
| 3,923,509 | 12/1975 | Kuehn | 430/87 |
| 3,932,181 | 4/1978 | Ray-Chadhuri et al. . | |
| 4,547,447 | 3/1981 | Ueda . | |

FOREIGN PATENT DOCUMENTS

| | | |
|---|---|---|
| O128309 | 12/1984 | European Pat. Off. . |
| 1622946 | 1/1971 | Fed. Rep. of Germany . |
| 2054715 | 6/1971 | Fed. Rep. of Germany . |
| 2239431 | 2/1973 | Fed. Rep. of Germany . |
| 2262088 | 7/1973 | Fed. Rep. of Germany . |
| 21551306 | 8/1976 | Fed. Rep. of Germany . |
| 21648278 | 5/1977 | Fed. Rep. of Germany . |
| 2904183 | 3/1979 | Fed. Rep. of Germany . |
| 3423141 | 1/1986 | Fed. Rep. of Germany . |
| 1141282 | 1/1964 | United Kingdom . |
| 1258766 | 12/1971 | United Kingdom . |
| 1326748 | 8/1973 | United Kingdom . |
| 1354194 | 5/1974 | United Kingdom . |
| 1361990 | 7/1974 | United Kingdom . |
| 1376196 | 12/1974 | United Kingdom . |
| 1402842 | 8/1975 | United Kingdom . |
| 14028 41 | 8/1975 | United Kingdom . |
| 1402515 | 8/1975 | United Kingdom . |
| 1498231 | 1/1978 | United Kingdom . |
| 1521059 | 8/1978 | United Kingdom . |
| 2014748 | 8/1979 | United Kingdom . |
| 2126741 | 3/1984 | United Kingdom . |

*Primary Examiner*—J. David Welsh

*Attorney, Agent, or Firm*—Sughrue, Mion, Zinn, Macpeak, and Seas

[57] ABSTRACT

An electrophotographic printing plate precursor is disclosed, comprising a conductive support having provided thereol at least one photoconductive layer containing photoconductive zinc oxide and at least one resin binder, wherein said resin binder contains at least one functional group capable of forming at least one hydroxyl group and at least one carboxyl group upon decomposition. The printing plate precursor can reproduce an image faithful to an original and exhibits satisfactory surface smoothness and electrostatic characteristics. The printing plate produced from the precursor does not cause background stains and exhibits excellent printing durability.

17 Claims, No Drawings

ELECTROPHOTOGRAPHIC LITHOGRAPHIC PRINTING PLATE PRECURSOR

FIELD OF THE INVENTION

This invention relates to an electrophotographic lithographic printing plate precursor, and, more particularly, to an improved resin binder forming a photoconductive layer of a lithographic printing plate precursor.

BACKGROUND OF THE INVENTION

A number of offset printing plate precursors for directly producing printing plates have hitherto been proposed, and some of them have already been put into practical use. Widely employed among them is a system in which a photoreceptor comprising a conductive support having provided thereon a photoconductive layer mainly comprising photoconductive particles, e.g., zinc oxide, and a resin binder is subjected to ordinary electrophotographic processing to form a highly lipophilic toner image thereon and the surface of the photoreceptor is then treated with an oil-desensitizing solution, referred to as an etching solution to selectively render non-image areas hydrophilic, to thus obtain an offset printing plate.

Requirements of offset printing plate precursors for obtaining satisfactory prints include: (1) an original should be reproduced faithfully on the photoreceptor; (2) the surface of a photoreceptor has affinity with an oil-desensitizing solution so as to render non-image areas sufficiently hydrophilic, while, at the same time, having water resistance; and (3) that a photoconductive layer having an image formed thereon is not released during printing and is well receptive to dampening water so that the non-image areas hold the hydrophilic properties enough to be free from stains even on printing a large number of prints.

It is known that these performance properties of the printing plate precursors are influenced by the ratio of zinc oxide to resin binder in the photoconductive layer. For example, as the ratio of resin binder to zinc oxide particles become small, oil-desensitization of the surface of the photoconductive layer is increased to reduce background stains, but, in turn, the internal cohesion of the photoconductive layer per se is weakened, resulting in reduction of printing durability due to insufficient mechanical strength. On the other hand, as the proportion of the resin binder increases, printing durability is improved, but background staining tends to become conspicuous. With respect to background staining, while it is a phenomenon associated with the degree of oil-desensitization achieved, it has been elucidated that the oil-desensitization of the photoconductive layer surface depends not only on the zinc oxide/resin binder ratio in the photoconductive layer, but also greatly on the kind of the resin binder used.

Resin binders which have been conventionally known include silicone resins (see Japanese Patent Publication No. 6670/59), styrene-butadiene resins (see Japanese Patent Publication No. 1960/60), alkyd resins, maleic acid resins, polyamides (see Japanese Patent Publication No. 11219/60), vinyl acetate resins (see Japanese Patent Publication No. 2425/66), vinyl acetate copolymer resins (see Japanese Patent Publication No. 2426/66), acrylic resins (see Japanese Patent Publication No. 11216/60), acrylic ester copolymer resins (see Japanese Patent Publication Nos. 11219/60, 8510/61, and 13946/66), etc. However, electrophotographic light-sensitive materials using these known resins suffer from any number of disadvantages, such as low charging characteristics of the photoconductive layer; poor quality of a reproduced image, particularly dot reproducibility or resolving power; low sensitivity to exposure; insufficient oil-desensitization attained by oil-desensitization for use as an offset master, which results in background stains on prints when used for offset printing; insufficient film strength of the light-sensitive layer, which causes release of the light-sensitive layer during offset printing, failing to obtain a large number of prints; susceptibility of image quality to influences of environment at the time of electrophotographic image formation, such as high temperatures and high humidities; and the like.

Particularly for use as an offset printing plate precursor, formation of background stains due to insufficient oil-desensitization presents a serious problem. In order to solve this problem, various resins have been proposed as binders for zinc oxide, including a resin having a molecular weight of from $1.8\times10^4$ to $1.0\times10^4$ and a glass transition point of from 10° to 80° C. obtained by copolymerizing a (meth)acrylate monomer and a copolymerizable monomer in the presence of fumaric acid in combination with a copolymer of a (meth)acrylate monomer and a copolymerizable monomer other than fumaric acid as disclosed in Japanese Patent Publication No. 31011/75; a terpolymer containing a (meth)acrylic ester unit having a substituent having a carboxylic group at least 7 atoms distant from the ester linkage as disclosed in Japanese Patent Application (OPI) No. 54027/78 (the term "OPI" as used herein means "unexamined published application"); a tetra- or pentapolymer containing an acrylic acid unit and a hydroxylethyl (meth)acrylate unit as disclosed in Japanese Patent Application (OPI) Nos. 20735/79 and 202544/82; a terpolymer containing a (meth)acrylic ester unit having an alkyl group having from 6 to 12 carbon atoms as a substituent and a vinyl monomer containing a carboxylic acid group as disclosed in Japanese Patent Application (OPI) No. 68046/83; and the like.

Nevertheless, evaluations of these resins proposed for improving oil-desensitization indicate that none of them is fully satisfactory in terms of stain resistance, printing durability, and the like.

SUMMARY OF THE INVENTION

One object of this invention is to provide a lithographic printing plate precursor which reproduces an image faithful to an original, forms neither background stains evenly over the entire surface nor dot-like stains, and exhibits excellent oil-desensitization.

Another object of this invention is to provide a lithographic printing plate which maintains sufficient hydrophilic properties on its non-image areas so as to have stain resistance and high printing durability even when used for printing a large number of prints.

A further object of this invention is to provide a lithographic printing plate which does not form background stains when used as an offset printing plate on which an image has been formed without using en electrophotographic system.

A still further object of this invention is to provide a lithographic printing plate which has a high quality image and does not cause background stains irrespective of a variation of environmental conditions of electrophotographic processing, such as temperature and humidity.

It has now been found that the above objects can be accomplished by an electrophotographic lithographic printing plate precursor obtained from an electrophotographic photoreceptor comprising a conductive support having provided thereon at least one photoconductive layer containing photoconductive zinc oxide and at least one resin binder, wherein said resin binder is a resin containing at least one functional group capable of forming at least one hydroxyl group upon decomposition and at least one carboxyl group upon decomposition.

DETAILED DESCRIPTION OF THE INVENTION

The resin which can be used in the present invention as a binder includes:

(1) copolymers comprising two or more monomer units each of which contains one of a substituent capable of forming a hydroxyl group upon decomposition and a substituent capable of forming a carboxyl group upon decomposition;

(2) homopolymers comprising a monomer unit which contains a substituent capable of forming a hydroxyl group upon decomposition and a substituent capable of forming a carboxyl group upon decomposition in its side chain or copolymers comprising such a monomer unit and one or more copolymerizable monomer units; and (3) homopolymers comprising a monomer unit which contains a substituent capable of simultaneously forming both a hydroxyl group and a carboxyl group upon decomposition (e.g., a lactone ring group) or copolymers comprising such a monomer unit and one or more copolymerizable monomer units.

The functional group capable of forming at least one hydroxyl group upon decomposition includes substituents represented by formulae (I), (II), and (III) shown below.

Formula (I) is represented by $$-O-L_1 \qquad \text{(I)}$$

wherein $L_1$ represents

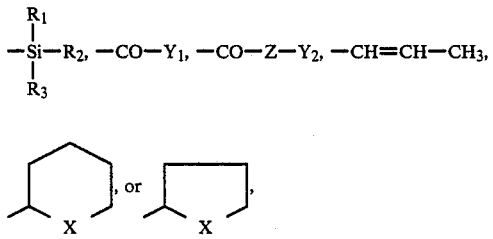

wherein $R_1$, $R_2$, and $R_3$ (which may be the same or different) each represents a hydrogen atom, a hydrocarbon group, or —O—R′, wherein R′ represents a hydrocarbon group; X represents a sulfur atom or an oxygen atom; $Y_1$ and $Y_2$ each represents a hydrocarbon group; and Z represents an oxygen atom, a sulfur atom, or —NH—.

Formula (II) is represented by

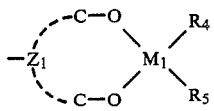

(II)

wherein $M_1$ represents a carbon atom or a silicon atom; $R_4$ and $R_5$ (which may be the same or different) each represents a hydrogen atom, a hydrocarbon group, or —O—R′, wherein R′ is as defined above; and $Z_1$ represents a carbon-carbon bond which may contain a hetero atom provided that the number of atoms between two oxygen atoms does not exceed 5.

Formula (III) is represented by

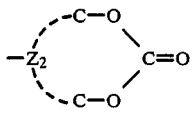

(III)

wherein $Z_2$ has the same meaning as $Z_1$ informula (II).

The functional group capable of forming at least one carboxyl group upon decomposition includes substituents represented by formulae (IV) and (V) shown below.

Formula (IV) is represented by $$-COO-L_2$$

wherein $L_2$ represents

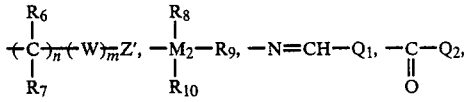

or —NH—OH, wherein $R_6$ and $R_7$ (which may be the same or different) each represents a hydrogen atom or an aliphatic group; W represents an aromatic group; Z′ represents a hydrogen atom, a halogen atom, a trihalomethyl group, an alkyl group, —CN, $—NO_2$, $—SO_2R_{11}$ ($R_{11}$ represents a hydrocarbon group), or $—O—R_{12}$ ($R_{12}$ represents a hydrocarbon group); and m and n each represents 0, 1, or 2; $R_8$, $R_9$, and $R_{10}$ (which may be the same or different) each represents a hydrocarbon group or $—O—R_{13}$ ($R_{13}$ represents a hydrocarbon group); $M_2$ represents Si, Sn, or Ti; and $Q_1$ and $Q_2$ each represents a hydrocarbon group.

Formula (V) is represented by

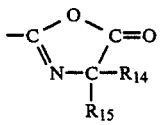

(V)

wherein $R_{14}$ and $R_{15}$ (which may be the same or different) each represents a hydrogen atom or a hydrocarbon group.

A preferred functional group capable of simultaneously forming at least one hydroxyl group and at least one carboxyl group upon decomposition is a lactone ring group.

When $L_1$ in formula (I) represents

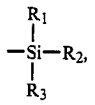

$R_1$, $R_2$, and $R_3$ each preferably represents a hydrogen atom, a substituted or unsubstituted straight or branched chain alkyl group having from 1 to 18 carbon atoms (e.g., a methyl group, an ethyl group, a propyl group, a butyl group, a hexyl group, an octyl group, a decyl group, a dodecyl group, an octadecyl group, a chloroethyl group, a methoxyethyl group, a methoxypropyl group, etc.), a substituted or unsubstituted alicyclic group (e.g., a cyclopentyl group, a cyclohexyl group, etc.), a substituted or unsubstituted aralkyl group having from 7 to 12 carbon atoms (e.g., a benzyl group, a phenethyl group, a chlorobenzyl group, a methoxybenzyl group, etc.), a substituted or unsubstituted aromatic group (e.g., a phenyl group, a naphthyl group, a chlorophenyl group, a tolyl group, a methoxyphenyl group, a methoxycarbonylphenyl group, a dichlorophenyl group, etc.), or —O—R′, wherein R′ is as defined above, and more specifically includes the hydrocarbon residues as recited for $R_1$, $R_2$, and $R_3$.

When $L_1$ in formula (I) represents —CO—$Y_1$ or —CO—Z—$Y_2$, $Y_1$ and $Y_2$ each preferably represents a substituted or unsubstituted straight or branched chain alkyl group having from 1 to 6 carbon atoms (e.g., a methyl group, a trichloromethyl group, a trifluoromethyl group, a methoxymethyl group, a phenoxymethyl group, a 2,2,2-trifluoroethyl group, a t-butyl group, a hexafluoroisopropyl group, etc.), a substituted or unsubstituted aralkyl group having from 7 to 9 carbon atoms (e.g., a benzyl group, a phenethyl group, a methylbenzyl group, a trimethylbenzyl group, a heptamethylbenzyl group, a methoxybenzyl group, etc.), or a substituted or unsubstituted aryl group having from 6 to 12 carbon atoms (e.g., a phenyl group, a nitrophenyl group, a cyanophenyl group, a methanesulfonylphenyl group, a methoxyphenyl group, a butoxyphenyl group, a chlorophenyl group, a dichlorophenyl group, a trifluoromethylphenyl group, etc.).

When $L_2$ in formula (IV) represents

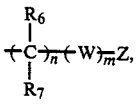

$R_6$ and $R_7$ each preferably represents a hydrogen atom or a substituted or unsubstituted straight or branched chain alkyl group having from 1 to 12 carbon atoms (e.g., a methyl group, an ethyl group, a propyl group, a chloromethyl group, a dichloromethyl group, a trichloromethyl group, a trifluoromethyl group, a butyl group, a hexyl group, an octyl group, a decyl group, a hydroxyethyl group, a 3-chloropropyl group, etc.); W preferably represents a substituted or unsubstituted phenyl or naphthyl group (e.g., a phenyl group, a methylphenyl group, a chlorophenyl group, a dimethylphenyl group, a chloromethylphenyl group, a naphthyl group, etc.); and Z′ preferably represents a hydrogen atom, a halogen atom (e.g., a chlorine atom, a fluorine atom, etc.), a trihalomethyl group (e.g., a trichloromethyl group, a trifluoromethyl group, etc.), a substituted or unsubstituted straight or branched chain alkyl group having from 1 to 12 carbon atoms (e.g., a methyl group, a chloromethyl group, a dichloromethyl group, an ethyl group, a propyl group, a butyl group, a hexyl group, a tetrafluoroethyl group, an octyl group, a cyanoethyl group, a chloroethyl group, etc.), —CN, —$NO_2$, —$SO_2R_{11}$ ($R_{11}$ preferably represents an aliphatic group (e.g., a substituted or unsubstituted alkyl group having from 1 to 12 carbon atoms, e.g., a methyl group, an ethyl group, a propyl group, a butyl group, a chloroethyl group, a benzyl group, an octyl group, etc., and a substituted or unsubstituted aralkyl group having from 7 to 12 carbon atoms, e.g., a benzyl group, a phenethyl group, a chlorobenzyl group, a methoxybenzyl group, a chlorophenethyl group, a methylphenethyl group, etc.) or an aromatic group (e.g., a substituted or unsubstituted phenyl or naphthyl group, e.g., a phenyl group, a chlorophenyl group, a dichlorophenyl group, a methylphenyl group, a methoxyphenyl group, an acetylphenyl group, an acetamidophenyl group, a methoxycarbonylphenyl group, a naphthyl group, etc.)), or —O—$R_{12}$ ($R_{12}$ has the same meaning as $R_{11}$).

Specific examples of the group represented by

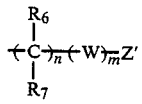

include a t-butyl group, a β,β,β-trichloroethyl group, a β,β,β-trifluoroethyl group, a hexafluoroisopropyl group, a group represented by the formula $CH_2$—$(CF_2CF_2)_{n'}$H, wherein n′ represents an integer of from 1 to 5, a 2-cyanoethyl group, a 2-nitroethyl group, a 2-methanesulfonylethyl group, a 2-ethanesulfonylethyl group, a 2-butanesulfonylethyl group, a benzenesulfonylethyl group, a 4-nitrobenzenesulfonylethyl group, a 4-cyanobenzenesulfinylethyl group, a 4-methylbenzenesulfonylethyl group, a substituted or unsubstituted benzyl group (e.g., a benzyl group, a methoxybenzyl group, a trimethylbenzyl group, a pentamethylbenzyl group, a nitrobenzyl group, etc.), a substituted or unsubstituted phenacyl group (e.g., a phenacyl group, a bromophenacyl group, etc.), a substituted or unsubstituted phenyl group (e.g., a phenyl group, a nitrophenyl group, a cyanophenyl group, a methanesulfonylphenyl group, a trifluoromethylphenyl group, a dinitrophenyl group, etc.), and so on.

When $L_2$ in formula (IV) represents

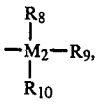

$R_8$, $R_9$ and $R_{10}$ each preferably represents a substituted or unsubstituted aliphatic group having from 1 to 18 carbon atoms (the aliphatic group includes an alkyl group, an alkenyl group, an aralkyl group, and an alicyclic group; the substituent therefor includes a halogen atom, —CN, —OH, —O—$Q_1$′ ($Q_1$′ represents an alkyl group, an aralkyl group, an alicyclic group, or an aryl group), etc.), a substituted or unsubstituted aromatic group having from 6 to 18 carbon atoms (e.g., a phenyl group, a tolyl group, a chlorophenyl group, a methoxyphenyl group, an acetamidophenyl group, a naphthyl group, etc.), or —O—$R_{13}$ (wherein $R_{13}$ preferably represents a substituted or unsubstituted alkyl group having from 1 to 12 carbon atoms, a substituted or unsubstituted alkenyl group having from 2 to 12 carbon atoms, a substituted or unsubstituted aralkyl group having from 7 to 12 carbon atoms, a substituted or unsubstituted alicyclic group having from 5 to 18 carbon atoms, or a substituted or unsubstituted aryl group having from 6 to 18 carbon atoms); and $M_2$ preferably represents an Si atom.

When $L_2$ in formula (IV) represents N=CH—$Q_1$ or

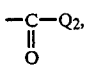

$Q_1$ and $Q_2$ each preferably represents a substituted or unsubstituted aliphatic group having from 1 to 18 carbon atoms (wherein the aliphatic group includes an alkyl group, an alkenyl group, an aralkyl group and an alicyclic group; and the substituent therefor includes a halogen atom, —CN, an alkoxy group, etc.) or a substituted or unsubstituted aryl group having from 6 to 18 carbon atoms (e.g., a phenyl group, a methoxyphenyl group, a tolyl group, a chlorophenyl group, a naphthyl group, etc.).

In formula (IV), $L_2$ preferably represents

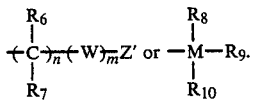

In formula (V), $R_{14}$ and $R_{15}$ each preferably represents a group selected from the groups enumerated above for $R_6$ and $R_7$.

The resin which can be used in the present invention can be prepared by Process (A), comprising converting a hydroxyl group and a carboxyl group of a polymer into the above-illustrated functional group through a polymeric reaction, or Process (B), comprising polymerizing a monomer containing the above-illustrated functional group or groups or copolymerizing such a monomer with other copolymerizable monomers.

According to Process (A), conversion of a hydroxyl group in a polymer to the functional group of formula (I) can be carried out with reference, e.g., to Y. Iwakura and K. Kurita, *Han-nosei Kobunshi,* p. 158, Kodansha.

Conversion of a hydroxyl group to the functional group of formula (II) or (III) can be effected by a polymeric reaction starting with a polymer having two hydroxyl groups spaced close together which comprises a repeating unit having two hydroxyl groups close to each other or a repeating unit capable of providing two hydroxyl groups spaced close together upon polymerization. Specific examples of such a repeating unit are:

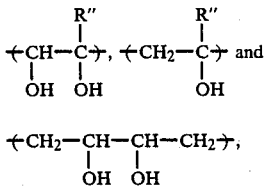

wherein R″ represents a hydrogen atom or a substituent, e.g., a methyl group, etc.

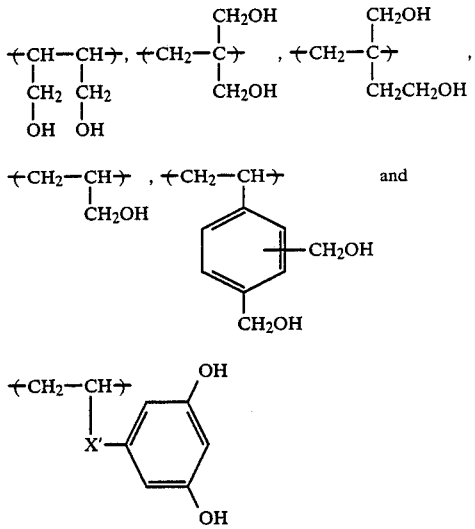

wherein X′ represents a linking group.

The polymer having these repeating units is reacted with a compound, such as carbonyl compounds, orthoester compounds, halogen-substituted formic esters, dihalogen-substituted silyl compounds, etc., thereby to form functional groups with two hydroxyl groups thereof being protected with one protective group. For details, Nihon Kagakukai (ed.), *Shin Jikken Kagaku Koza,* Vol. 14, "Yuki Kagobutsu no Gose to Han-no (V)", p. 2505, Maruzen K. K.; J. F. W. Mc. Omie, *Protective Groups in Organic Chemistry,* Chapters 3 and 4, Plenum. Press, etc., can be referred to.

Conversion of a carboxyl group in a polymer to the functional group of formula (IV) can be carried out by the process described, e.g., in Nihon Kagakukai (ed.), *Jikken Kagaku Koza,* Vol. 14, "Yuki Kagobutsu no Gosei to Han-no (V)", p. 2535, Maruzen K. K.; Y. Iwakura, et al., *Han-nosei Kobunshi,* p. 170, Kodansha, etc.

When the resin of the present invention is prepared by polymerization in accordance with Process (B), the monomer containing any of the functional groups of formulae (I) to (IV) is synthesized by known processes as described in the above-cited references. The monomer containing the functional group of formula (II) may also be synthesized by the process described in Y. Iwakura, F. Toda, Y. Torii, *J. Polymer Sci. A*-1, Vol. 4, p. 2649 (1966), ibid., Vol. 6, p. 2681 (1968), etc. The monomer containing a lactone ring group capable of forming both a hydroxyl group and a carboxyl group can be synthesized by the process described, e.g., in R. Liepins and C. S. Marvel, *J. Polymer Sci. A*-1, Vol. 5, p. 1489 (1967), etc. These monomers may be homopolymerized, or, if desired, copolymerized with other copolymerizable monomers.

Process (B) is preferred to Process (A) because the former process can be used to arbitrarily control the functional groups to be introduced and allows no incorporation of impurities.

As indicated above, the resin according to the present invention may be either a homopolymer or a copolymer with other copolymerizable monomers. Examples of the comonomers to be used include vinyl or allyl esters of aliphatic carboxylic acids, e.g., vinyl acetate, vinyl propionate, vinyl butyrate, allyl acetate, allyl propionate, etc.; esters or amides of unsaturated carboxylic acids, e.g., acrylic acid, methacrylic acid, crotonic acid, itaconic acid, maleic acid, fumaric acid, etc.; styrene derivatives, e.g., styrene, vinyltoluene, α-methylstyrene, etc.; αolefins; acrylonitrile, methacrylonitrile; vinyl-substituted heterocyclic compounds, e.g., N-vinylpyrrolidone, etc.; and the like.

When the resin of the invention is a copolymer comprising a monomer or monomers containing the functional group or groups, the total content of such a monomer or monomers ranges from 0.1 to 100% by weight, and preferably from 0.5 to 100% by weight, based on the copolymer. The proportion of the monomer unit containing at least one of the functional groups of formulae (I), (II), and (III) to the monomer unit containing at least one of the functional groups of formulae (IV) and (V) is generally from 99.5/0.5 to 0.5/99.5, and preferably from 80/20 to 20/80.

The resin according to this invention generally has a molecular weight of from $10^3$ to $10^6$, and preferably from $5\times10^3$ to $5\times10^5$.

Specific but non-limiting examples of the monomer units containing the functional groups selected from the groups of formulae (I) to (V) and lactone rings are shown below. Of the following monomer units, those containing a functional group capable of forming at least one hydroxyl group upon decomposition (numbered with an initial A) and those containing a functional group capable of forming at least one carboxyl group upon decomposition (numbered with an initial B) should be used in combination with each other.

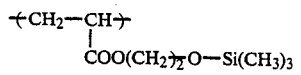
(A-1)

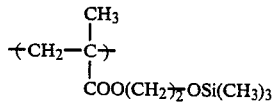
(A-2)

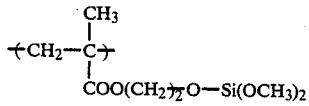
(A-3)

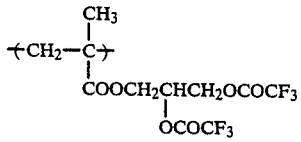
(A-4)

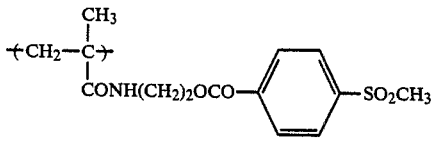
(A-5)

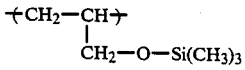
(A-6)

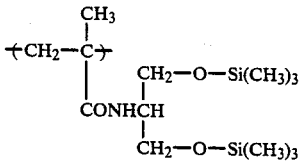
(A-7)

-continued

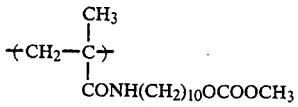
(A-8)

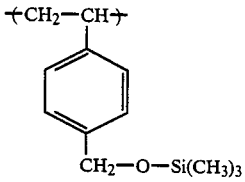
(A-9)

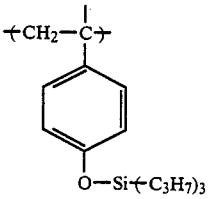
(A-10)

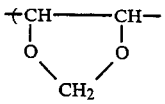
(A-11)

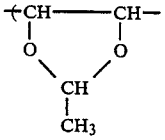
(A-12)

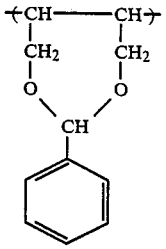
(A-13)

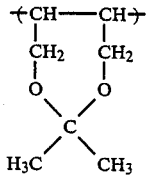
(A-14)

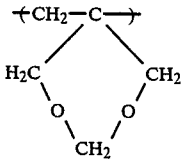
(A-15)

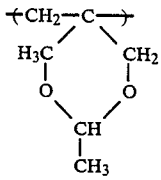
(A-16)

-continued
(A-17)
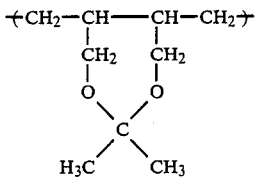
(A-18)
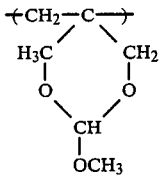
(A-19)
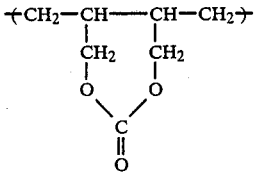
(A-20)
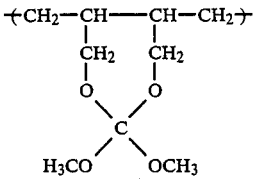
(A-21)
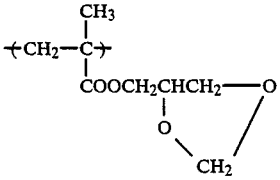
(A-22)
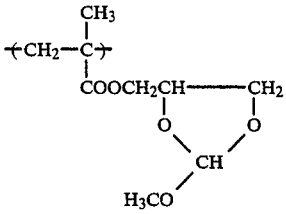
(A-23)
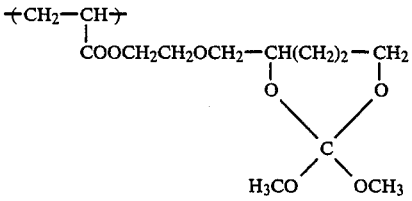
(A-24)
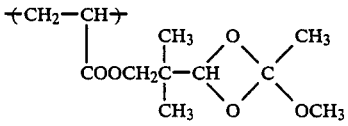
-continued
(A-25)
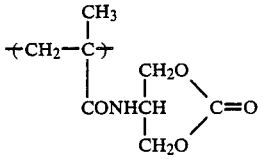
(A-26)
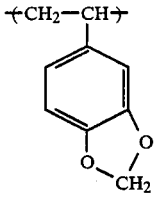
(A-27)
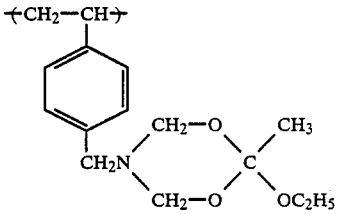
(A-28)
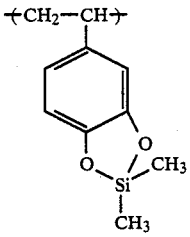
(B-1)
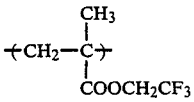
(B-2)
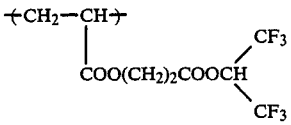
(B-3)
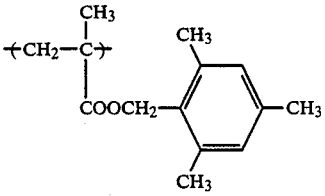
(B-4)
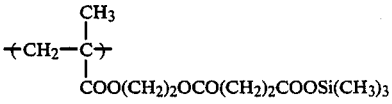
(B-5)
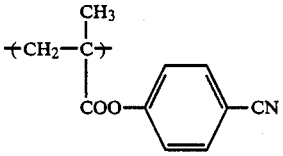

-continued
(B-6)
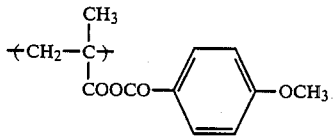
(B-7)
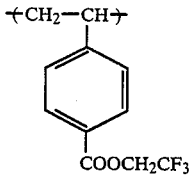
(B-8)
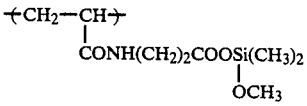
(B-9)
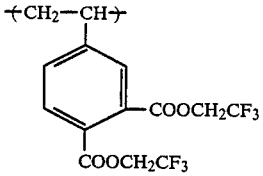
(B-10)
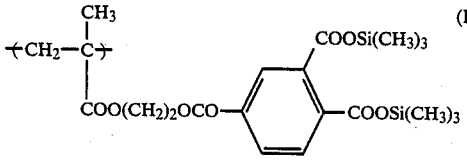
(B-11)
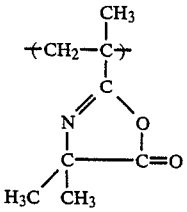
(B-12)
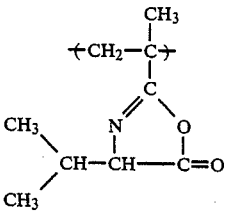
(B-13)
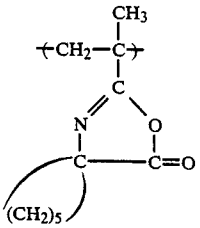
-continued
(B-14)
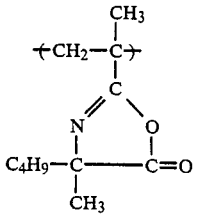
Examples of monomer units containing a functional group capable of forming at least one hydroxyl group and at least one carboxyl group upon decomposition are as follows.
(C-1)
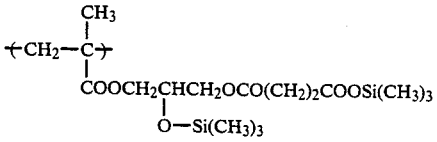
(C-2)
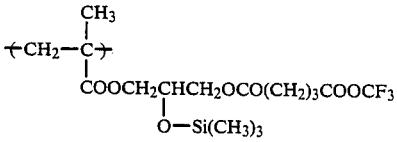
(C-3)
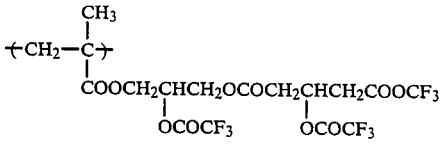
(C-4)
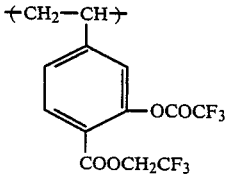
(C-5)
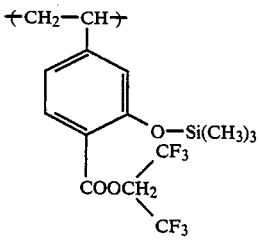
(C-6)
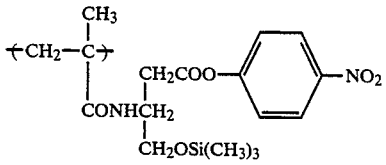
(C-7)
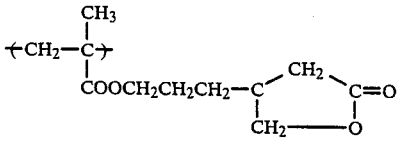

-continued (C-8)

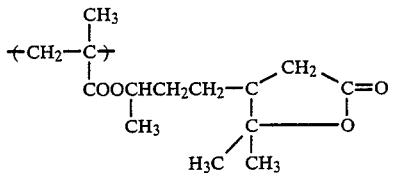

In the present invention, conventionally known resin may also be used as a binder in combination with the abovedescribed resins according to the present invention. Such resins include silicone resins, alkyd resins, vinyl acetate resins, polyester resins, styrene-butadiene resins, acrylic resins, and the like. Specific examples of these resins are described, e.g., in T. Kurita et al., *Kobunshi,* Vol. 17, p. 278 (1968), H. Miyamoto et al., *Imaging,* No. 8, p. 9 (1973), etc.

The resin according to the present invention and the known resins may be used at arbitrary mixing ratios, but it is suitable that the resin of the invention, i.e., functional group-containing resin, be used in an amount of from about 1 to 80%, and preferably from 3 to 30%, by weight, based on the total weight of resin binder. If the proportion of the resin of the invention is less than about 1% by weight, the resulting lithographic printing plate precursor does not show sufficient oil-desensitization when processed with an oil-desensitizing solution or dampening water, thus resulting in stain formation during printing. On the other hand, if it exceeds about 80% by weight, the resulting printing plate precursor tends to have deteriorated imageforming performance, or the photoconductive layer tends to have reduced film strength, leading to deteriorated mechanical durability of the printing plate.

The resin according to the present invention is hydrolyzed or hydrogenolyzed upon contact with an oil-desensitizing solution or dampening water used on printing thereby to form a hydroxyl group and a carboxyl group. Therefore, when the resin is used as a binder for a lithographic printing plate precursor, hydrophilic properties of non-image areas attained by processing with an oil-desensitizing solution can be enhanced by the thus formed hydroxyl group and carboxyl group. As a result, a distinct contrast can be provided between lipophilic properties of image areas and hydrophilic properties of non-image areas to prevent adhesion of a printing ink onto the non-image areas during printing.

In the case where conventional resin binders are employed in the production of lithographic printing plate precursors, a dispersion of zinc oxide in these resins has viscosity too high to be coated. If any coating may be formed, the resulting photoconductive layer has seriously deteriorated smoothness, resulting in insufficient film strength, unsatisfactory electrophotographic characteristics, and causes stain formation during printing.

These unfavorable phenomena accompanying the conventional lithographic printing plate precursors are presumably attributable to several reasons.

First, the amount of the resin adsorbed on the surfaces of zinc oxide particles is large due to strong interaction between hydroxyl groups and/or carboxyl groups in the resin binder and surfaces of photoconductive zinc oxide particles. As a result, compatibility of the photoconductive layer with an oil-desensitizing solution or dampening water is impaired.

To the contrary, the hydroxyl groups and carboxyl groups in the resin of the present invention are protected so as not to exert such a strong interaction with zinc oxide particles. These protected groups then form hydrophilic hydroxyl groups and carboxyl groups upon receipt of the oildesensitizing solution.

If the conventional resin containing hydroxyl groups and carboxyl groups from the beginning is adjusted so as to have an increased hydroxyl group content with a decreased carboxyl group content, the above-described unfavorable phenomena would occur in most cases. On the other hand, the hydroxyl group content in the conventional resin may be adjusted so as to produce a printing plate precursor which can form a satisfactory image and provide a satisfactory print, but the quality of the image formed on the precursor easily undergoes deterioration, such as formation of background fog, reduction in density of image areas, and disappearance of fine lines or letters, when the environmental conditions at the time of image formation processing change to low-temperature and low-humidity conditions or high-temperature and high-humidity conditions, and particularly to high-temperature and high-humidity conditions.

Even when the hydroxyl groups in the resin binder may be adjusted adequately with respect to zinc oxide particles, the hydrophilic atmosphere on the boundaries between the hydroxyl groups in the resin and the zinc oxide particles greatly changes upon exposure to a low-temperature and low-humidity condition or a high-temperature and high-humidity condition so that electrophotographic characteristics, such as surface potential or dark decay after charging, and the like, would be deteriorated.

The photoconductive layer of the lithographic printing plate precursor according to the present invention usually comprises from 10 to 60 parts by weight, and preferably from 15 to 30 parts by weight, of the resin binder per 100 parts by weight of photoconductive zinc oxide. If desired, the photoconductive layer may further contain various additives known for electrophotographic light-sensitive layers, such as sensitizing dyes including xanthene dyes, cyanine dyes, etc., chemical sensitizers, e.g., acid anhydrides, and the like. Specific examples of usable additives are described, e.g., in H. Miyamoto, et al., *Imaging,* No. 8, p. 12 (1973). The total amount of these additives ranges from 0.0005 to 2.0 parts by weight per 100 parts by weight of a photoconductive substance.

The photoconductive layer according to the present invention can be provided on any known support. In general, a support for an electrophotographic light-sensitive layer is preferably electrically conductive. Any of conventionally employed conductive supports may be utilized in this invention. Examples of usable conductive supports include a base, e.g., a metal sheet, paper, a plastic sheet, etc., having been rendered electrically conductive by, for example, impregnating with a low resistant substance; a base with the back side thereof (opposite to the light-sensitive layer side) being rendered conductive, and further coated thereon at least one layer for the purpose of prevention of curling, etc.; the aforesaid supports having provided thereon a water-resistant adhesive layer; the aforesaid supports having provided thereon at least one precoat layer; paper laminated with a plastic film on which aluminum, etc., is deposited; and the like.

Specific examples of conductive supports and materials for imparting conductivity which can be used in the present invention are described in S. Sakamoto, *Denshi-shashin,* Vol. 54, No. 1, pp. 2-11 (1975); H. Moriga, *Nyumon Tokushushi no Kagaku,* Kobunshi Kankokai (1975); M. F. Hoover, *J. Macromol. Sci. Chem.,* A-4(6), pp. 1327–1414 (1970); etc.

The present invention is now illustrated in greater detail by way of example, but it should be understood that the present invention is not limited thereto. In these examples, all the percents are given by weight unless otherwise indicated.

EXAMPLE 1 AND COMPARATIVE EXAMPLES 1 TO 3

A mixed solution consisting of 60 g of n-butyl methacrylate, 30 g of a monomer corresponding to Monomer Unit A-2), 10 g of a monomer corresponding to Monomer Unit B-1), 0.2 g of acrylic acid, and 200 g of toluene was heated to 70° C. under a nitrogen stream, and 1.0 g of azobisisobutyronitrile (AIBN) was added thereto, followed by allowing the resulting mixture to react for 8 hours. The resulting copolymer had a weight average molecular weight of 65,000.

A mixture of 40 g (solid basis) of the resulting copolymer, 200 g of zinc oxide, 0.05 g of Rose Bengal, 0.01 g of phthalic anhydride, and 300 g of toluene was dispersed in a ball mill for 2 hours to prepare a lightsensitive coating composition. The composition was coated on paper having been rendered conductive to a dry coverage of 25 g/m$^2$ with a wire bar coater, followed by drying at 110° C. for 1 minute. The support having formed thereon a light-sensitive layer was then allowed to stand in a dark place at 20° C. and 65% RH (relative humidity) for 24 hours to produce an electrophotographic lithographic printing plate precursor. The resulting printing plate precursor was designated as Sample 101.

Comparative Samples A to C were produced in the same manner as for Sample 101, except for using copolymers shown below as the resin binder.

Sample A: A copolymer (weight average molecular weight: 68,000; solid concentration: 33.28%) prepared in the same manner as described for Sample 101 except for using a mixture consisting of 100 g of n-butyl methacrylate, 0.2 g of acrylic acid, and 200 g of toluene.

Sample B: A copolymer (weight average molecular weight: 74,000; solid concentration: 33.3%) prepared in the same manner as described for Sample 101 except for using a mixture consisting of 75 g of n-butyl methacrylate, 20 g of 2-hydroxyethyl methacrylate, 5.0 g of acrylic acid, and 200 g of toluene.

Sample C: A copolymer (weight average molecular weight: 71,000; solid concentration: 33.1%) prepared in the same manner as described for Sample 101 except for using a mixture consisting of 70 g of n-butyl methacrylate, 20 g of 2-hydroxyethyl methacrylate, 10 g of acrylic acid, and 200 g of toluene.

Each of the resulting lithographic printing plate precursors (Samples 101 and A to C) was evaluated for film properties in terms of surface smoothness; electrostatic characteristics; oil-desensitization of the photoconductive layer in terms of contact angle with water after oil-desensitization; quality of reproduced image; and printing performances in terms of stain resistance in accordance with the following test methods.

1. Smoothness of Photoconductive Layer

The smoothness (sec/cc) was measured by means of a Beck's smoothness tester manufactured by Kumagaya Riko K. K. under an air volume condition of 1 cc.

2. Electrostatic Characteristics

The sample was negatively charged by corona discharge to a voltage of 6 kV for 20 seconds in a dark room at 20° C. and 65% RH using a paper analyzer ("Paper Analyzer SP-428" manufactured by Kawaguchi Denki K.K.). After the lapse of 10 seconds from the end of the corona discharge, the surface potential $V_0$ was measured. Then, the photoconductive layer was irradiated with visible light at an illumination of 2.0 lux, and the time required for dark decay of the surface potential $V_0$ to one-tenth was determined. The amount of exposure $E_{1/10}$ (lux.sec) was then calculated from the time of dark decay.

3. Contact Angle with Water

The sample was passed once through an etching processor using an oil-desensitizing solution ("ELP-E" produced by Fuji Photo Film Co., Ltd.) to render the surface of the photoconductive layer oil-desensitive. On the thus oil-desensitized surface was placed a drop of 2 μl of distilled water, and the contact angle formed between the surface and water was measured by a goniometer.

4. Image Quality

A printing plate was produced from the sample which had been allowed to stand under an ambient condition (20° C., 65% RH; Condition I) overnight, and an image was formed thereon using an automatic printing plate making machine "ELP 404V" (manufactured by Fuji Photo Film Co., Ltd.) which had also been allowed to stand under the same condition as for the sample. The image formed on the resulting printing plate was visually evaluated in terms of fog and image quality. Then, the same evaluation was repeated, except that the sample and the printing plate making machine were allowed to stand under a high temperature-high humidity condition (30° C., 80% RH: Condition II) overnight.

5. Stain Resistance

The sample was processed with ELP 404V to form a toner image, and the surface of the photoconductive layer was subjected to oil-desensitization under the same conditions as in 3) above. The resulting printing plate was mounted on a printer "Hamada Star 800SX" (manufactured by Hamada Star K.K.), and printing was carried out on fine paper in a usual manner (Condition I) to obtain 500 prints. All the resulting prints were visually evaluated for background stains. The same evaluation was repeated except for printing under severer conditions, i.e., by using a 5-fold diluted oil-desensitizing solution and a 2-fold diluted dampening water for printing (Condition II).

The results of these evaluations are shown in Table 1 below.

TABLE 1

| | Sample 101 | Sample A | Sample B | Sample C |
|---|---|---|---|---|
| Smoothness of Photoconductive | 85 | 90 | 80 | 30 |

TABLE 1-continued

| | Sample 101 | Sample A | Sample B | Sample C |
|---|---|---|---|---|
| Layer (sec/cc) Electrostatic Characteristics: | | | | |
| $V_0$ (V) | 560 | 550 | 550 | 550 |
| $E_{1/10}$ (lux · sec) | 8 | 8 | 8.5 | 9.5 |
| Contact Angle with Water (°) | 3 | 25 | 13 | 6–20 (large scatter) |
| Image Quality: | | | | |
| Condition I | excellent | excellent | excellent | good |
| Condition II | excellent | excellent | poor | very poor |
| Stain Resistance: | | | | |
| Condition I | excellent | poor | excellent | poor |
| Condition II | excellent | very poor | excellent | very poor |

The following observations can be made on the Table. All the reproduced images on the printing plates obtained from Samples 101, A and B were very clear, while that of Sample C was unclear and very foggy on the non-image areas due to serious deterioration in smoothness of the photoconductive layer. When the samples were processed under Condition II (30° C., 80% RH), Samples B and C underwent significant deterioration of reproduced image quality, i.e., background fog occurred and the image density was reduced to 0.6 or less.

The contact angle between oil-desensitized surface of Sample 101 or B with water is small as 13° or less, indicating that the surface has sufficient hydrophilic properties.

It is also apparent that the printing plate obtained from Sample 101 or B does not form background stains when used for printing as an offset master plate. These plates could produce more than 10,000 prints having satisfactory image quality free from background stains, whereas the plates obtained from Samples A and C formed background stains when used for printing 10,000 prints.

From these considerations, it is obvious that only the printing plate precursor according to the present invention can always reproduce a clear image even when processed under varying conditions and provide a printing plate which does not form background stains even when used for producing more than 10,000 prints.

Further, when the same evaluation on Sample 101 was repeated after it was allowed to stand for two weeks at 45° C. and 75% RH (relative humidity), no change in performance with time was observed.

EXAMPLE 2 and COMPARATIVE EXAMPLE 4

A mixed solution consisting of 90 g of n-butyl methacrylate, 10 g of a monomer corresponding to Monomer Unit 3), 0.2 g of acrylic acid, and 200 g of toluene was heated to 75° C. under a nitrogen stream, and 2.0 g of AIBN was added thereto, followed by allowing the mixture to react for 8 hours.

The resulting copolymer had a solid concentration of 33.1% and a weight average molecular weight of 38,000. A lithographic printing plate precursor was prepared in the same manner as described in Example 1. This sample was designated as Sample 201.

For comparison, Sample D was produced in the same manner as for Sample 201, except for replacing the copolymer used in Sample 201 with a copolymer prepared in the same manner as for Sample 201 except for starting with a mixed solution consisting of 90 g of n-butyl methacrylate, 10 g of a compound of the formula

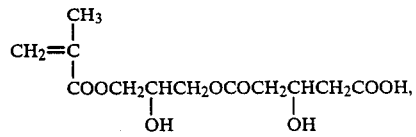

and 200 g of toluene (solid concentration: 33.0%; weight average molecular weight: 41,000).

Each of Samples 201 and D was evaluated in the same manner as in Example 1, and the results obtained are shown in Table 2 below.

TABLE 2

| | Sample 102 | Sample D |
|---|---|---|
| Smoothness of Photoconductive Layer (sec/cc) Electrostatic Characteristics: | 85 | 25 |
| $V_0$ (V) | 555 | 560 |
| $E_{1/10}$ (lux · sec) | 8.5 | 9.5 |
| Contact Angle with Water (degree) | 4° | 10–25° (large scatter) |
| Image Quality: | | |
| Condition I | excellent | good |
| Condition II | excellent | very poor |
| Stain Resistance: | | |
| Condition I | excellent | poor |
| Condition II | excellent | very poor |

As can be seen from Table 2, the reproduced image on Sample 201 according to the present invention was clear, while that of Sample D was unclear and very foggy in the non-image areas, due to deteriorated surface smoothness of the photoconductive layer. Sample 201 exhibits superiority as to all qualities of the image formed, i.e., as to high-temperature and high-humidity conditions, as to oil-desensitization of the photoconductive layer, and as to printing properties, as compared with Sample D.

When Sample 201 was processed with ELP 404V in the same manner as in Example 1, the resulting master plate for offset printing had a clear image having a density of 1.2 or higher. When, after etching, the master plate was mounted on a printer, and printing was carried out, more than 10,000 prints having a clear image free from fog in non-image areas were obtained.

Further, when Sample 201 was processed in the same manner as described above after it was allowed to stand for two weeks at 45° C. and 75% RH, no change in performance with time was observed.

EXAMPLE 3

A lithographic printing plate precursor was prepared in the same manner as in Example 1, except for using a copolymer prepared from a mixed solution consisting of 60 g of benzyl methacrylate, 30 g of a monomer corresponding to Monomer Unit A-24), 10 g of a monomer corresponding to Monomer Unit B-2), 0.2 g of acrylic acid, and 200 g of toluene. A master plate for offset printing was produced from the resulting precursor in the same manner as in Example 1. The master plate had a clear image having a density of 1.0 or higher. After etching, the master plate was mounted on a printer, and printing was carried out. As a result, more than 10,000 prints having a clear image free from fog in non-image areas were obtained.

When the precursor was processed after it was allowed to stand for two weeks at 45° C. and 75% RH, no change in performance with time was observed.

EXAMPLE 4

A mixed solution consisting of 75 g of n-butyl methacrylate, 15 g of a monomer corresponding to Monomer Unit A-25), 10 g of a monomer corresponding to Monomer Unit B-12), and 200 g of toluene was subjected to polymerization under the same conditions as in Example 1 to prepare a resin having a solid concentration of 33.0% and a weight average molecular weight of 65,000.

A lithographic printing plate precursor was produced in the same manner as in Example 1, except for using, as a resin binder, 30 g (solids basis) of the above obtained resin and 10 g of an n-butyl methacrylate/acrylic acid copolymer (98/2 by weight).

When the printing plate precursor was processed with ELP 404V in the same manner as in Example 1, the resulting master plate for offset printing had a clear image having a density of 1.0 or higher. After etching, the master plate was used for printing to obtain more than 10,000 clear prints free from fog in non-image areas. When the same procedure was repeated after two weeks at 45° C. and 75% RH, no change in performance with time was observed.

As described above, the lithographic printing plate precursor in accordance with the present invention reproduces an image faithful to an original and exhibits very satisfactory surface smoothness and electrostatic characteristics. The printing plate produced from the precursor of the present invention does not cause background stains owing to satisfactory hydrophilic properties of non-image areas and exhibits excellent printing durability.

In addition, the printing plate precursor according to the present invention is not liable to variations in image-forming properties due to change of conditions for image formation processing, and is also superior in preservability before image formation processing.

While the invention has been described in detail and with reference to specific embodiments thereof, it will be apparent to one skilled in the art that various changes and modifications can be made therein without departing from the spirit and scope thereof.

What is claimed is:

1. An electrophotographic printing plate precursor comprising a conductive support having provided thereon at least one photoconductive layer containing photoconductive zinc oxide and at least one resin binder, said printing plate precursor capable of producing a lithographic printing plate by a process involving electrophotographically forming an image on said photoconductive layer followed by subjecting said photoconductive layer to an oil-desenzitization treatment, wherein said resin binder is selected from the gorup consisting of (a) a resin binder which contains at least one functional group capable of forming at least one hydroxyl group upon decomposition by an oil desensitization treatment and at least one carboxyl group upon decomposition by an oil desensitization treatment and (b) a resin binder which contains at least one functional group capable of simultaneously forming both a hydroxyl group and a carboxyl group upon decomposition by an oil desensitization treatment.

2. An electrophotographic printing plate precursor as in claim 1, wherein said resin binder contains at least one functional group capable of forming at least one hydroxyl group upon decomposition by an oil densensitization treatment and at least one functional group capable of forming at least one carboxyl group upon decomposition by an oil desensitization treatment.

3. An electrophotographic printing plate precursor as in claim 2, wherein said functional group capable of forming at least one hydroxyl group upon decomposition is selected from a group represented by formula (I)

$$-O-L \qquad (I)$$

wherein $L_1$ represents

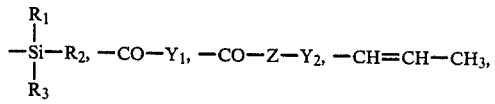

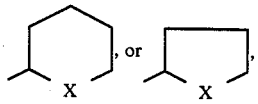

wherein $R_1$, $R_2$, and $R_3$ each represents a hydrogen atom, a hydrocarbon group, or —O—R′, wherein R′ represents a hydrocarbon group; X represents a sulfur atom or an oxygen atom; $Y_1$ and $Y_2$ each represents a hydrocarbon group; and Z represents —O—, —S—, or —NH—; a group represented by formula (II)

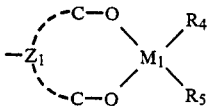

(II)

wherein $M_1$ represents a carbon atom or a silicon atom; $R_4$ and $R_5$ each represents a hydrogen atom, a hydrocarbon group, or —O—R′, wherein R′ represents a hydrocarbon group; and $Z_1$ represents a carbon-carbon bond which may contain a hetero atom provided that the number of atoms between two oxygen atoms does not exceed 5; and a group represented by formula (III)

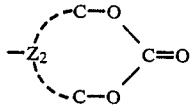

(III)

wherein $Z_2$ represents a carbon-carbon bond which may contain a hetero atom, provided that the number of atoms between two oxygen atoms does not exceed 5; and said functional group capable of forming a carboxyl group upon decomposition is selected from the group consisting of a group represented by formula (IV)

$$-COO-L_2 \qquad (IV)$$

wherein $L_2$ represents

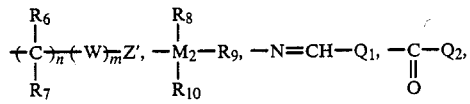

or —NH—OH, wherein $R_6$ and $R_7$ each represents a hydrogen atom or an aliphatic group; W represents an aromatic group; Z' represents a hydrogen atom, a halogen atom, a trihalomethyl group, an alkyl group, —CN, —$NO_2$, —$SO_2R_{11}$, wherein $R_{11}$ represents a hydrocarbon group, or —O—$R_2$, wherein $R_{12}$ represents a hydrocarbon group; and m and n each represents 0, 1, or 2; $R_8$, $R_9$, and $R_{10}$ each represents a hydrocarbon group or —O—$R_{13}$, wherein $R_{13}$ represents a hydrocarbon group; $M_2$ represents Si, Sn, or Ti; and $Q_1$ and $Q_2$ each represents a hydrocarbon group; and a group represented by formula (V)

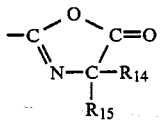

(V)

wherein $R_{14}$ and $R_{15}$ each represents a hydrogen atom or a hydrocarbon group.

4. An electrophotographic printing plate precursor as in claim 1, wherein said resin binder contains at least one functional group capable of simultaneously forming both a hydroxyl group and a carboxyl group upon decomposition by an oil desensitization treatment.

5. An electrophotographic printing plate precursor as in claim 4, wherein said functional group is a lactone ring group.

6. An electrophotographic printing plate precursor as in claim 3, wherein $R_1$, $R_2$, and $R_3$ each represents a hydrogen atom, a substituted or unsubstituted straight or branched chain alkyl group having from 1 to 18 carbon atoms, a substituted or unsubstituted alicyclic group, a substituted or unsubstituted aralkyl group having from 7 to 12 carbon atoms, a substituted or unsubstituted aromatic group, or —O—R', wherein R' represents a substituted or unsubstituted straight or branched chain alkyl group having from 1 to 18 carbon atoms, a substituted or unsubstituted alicyclic group, a substituted or unsubstituted aralkyl group having from 7 to 12 carbon atoms, or a substituted or unsubstituted aromatic group; $Y_1$ and $Y_2$ each represents a substituted or unsubstituted straight or branched chain alkyl group having from 1 to 6 carbon atoms, a substituted or unsubstituted aralkyl group having from 7 to 9 carbon atoms, or a substituted or unsubstituted aryl group having from 6 to 12 carbon atoms; $R_6$ and $R_7$ each represents a hydrogen atom, a substituted or unsubstituted straight or branched chain alkyl group having from 1 to 12 carbon atoms; W represents a substituted or unsubstituted phenyl or naphthyl group; Z' represents a hydrogen atom, a halogen atom, a trihalomethyl group, a substituted or unsubstituted straight or branched chain alkyl group having from, 1 to 12 carbon atoms, —CN, —$NO_2$, —$SO_2R_{11}$, wherein $R_{11}$ represents an aliphatic group or an aromatic group, or —O—$R_{12}$, wherein $R_{12}$ represents an aliphatic group or an aromatic group; $R_8$, $R_9$, and $R_{10}$ each represents a substituted or unsubstituted aliphatic group having from 1 to 18 carbon atoms, a substituted or unsubstituted aromatic group having from 6 to 18 carbon atoms, or —O—$R_{13}$, wherein $R_{13}$ represents a substituted or unsubstituted alkyl group having from 1 to 12 carbon atoms, a substituted or unsubstituted alkenyl group having from 2 to 12 carbon atoms, a substituted or unsubstituted aralkyl group having from 7 to 12 carbon atoms, a substituted or unsubstituted alicyclic group having from 5 to 18 carbon atoms, or a substituted or unsubstituted aryl group having from 6 to 18 carbon atoms; $M_2$ represents an Si atom; $Q_1$ and $Q_2$ each represents a substituted or unsubstituted aliphatic group having from 1 to 18 carbon atoms or a substituted or unsubstituted aryl group having from 6 to 18 carbon atoms; and $R_{14}$ and $R_{15}$ each represents a hydrogen atom, a substituted or unsubstituted, straight or branched chain alkyl group having from 1 to 12 carbon atoms.

7. An electrophotographic printing plate precursor as in claim 1, wherein said resin binder comprises from 0.1 to 100% by weight of a monomer unit or units containing said functional group or groups.

8. An electrophotographic printing plate precursor as in claim 7, wherein resin binder comprises from 0.5 to 100% by weight of a monomer unit or units containing said functional group or groups.

9. An electrophotographic printing plate precursor as in claim 3, wherein said resin binder comprises a monomer unit containing at least one of the functional groups represented by formulae (I), (II), and (III) and a monomer unit containing at least one of the functional groups represented by formulae (IV) and (V) at a weight ratio of from 99.5/0.5 to 0.5/99.5.

10. An electrophotographic printing plate precursor as in claim 9, wherein said resin binder comprises a monomer unit containing at least one of the functional groups represented by formulae (I), (II), and (III) and a monomer unit containing at least one of the functional groups represented by formulae (IV) and (V) at a weight ratio of from 80/20 to 20/80.

11. An electrophotographic printing plate precursor as in claim 1, wherein said resin binder has a weight average molecular weight of from $10^3$ to $10^6$.

12. An electrophotographic printing plate precursor as in claim 11, wherein said resin binder has a weight average molecular weight of from $5\times10^3$ to $1\times10^5$.

13. An electrophotographic printing plate precursor as in claim 1, wherein said resin binder is present in an amount of from 1 to 80% by weight based on the total weight of resin binder.

14. An electrophotographic printing plate precursor as in claim 13, wherein said resin binder is present in an amount of from 3 to 30% by weight based on the total weight of resin binder.

15. An electrophotograpic printing plate precursor comprising a conductive support having provided thereon at least one photoconductive layer containing photoconductive zinc oxide and at least one resin binder, said printing plate precursor capable of producing a lithographic printing plate by a means involving electrophotographically forming an image on said photoconductive layer followed by subjecting said photoconductive layer to an oil-desensitization treatment, wherein said resin is selected from the group consisting of:

(a) copolymers comprising two or more monomer units wherein at least one of said monomer units contains a substituent capable of forming a hydroxyl group upon decomposition and at least one of said monomer units contains a subtituent capable of forming a carboxyl group upon decomposition;

(b) homopolymers comprising a monomer unit which contains a substituent capable of forming a hydroxyl group upon decomposition and a substituent capable of forming a carboxyl group upon decomposition in its side chain;

(c) copolymers comprising a monomer unit which contains a substituent capable of forming a hydroxyl group upon decomposition and a substituent capable of forming a hydroxyl group upon decomposition and one or more copolymerizable monomer units;

(d) homopolymers comprising a monomer unit which contains a substituent capable of simultaneously forming both a hydroxyl group and a carboxyl group upon decomposition; and (e) copolymers comprising a monomer unit which contains a substituent capable of simultaneously forming both a hydroxyl group and a carboxyl group upon decomposition and one or more copolymerizable monomer units.

16. An electrophotographic printing plate and precursor as in claim 15, wherein said resin is capable of being hydrolized or hydrogenolyzed upon contact with an oil-densensitizing solution or damping water used on printing thereby to form hydroxyl and carboxyl groups.

17. An electrophotographic printing plate and precursor as in claim 1, wherein said resin is capable of being hydrolized or hydrogenolyzed upon contact with an oil-densensitizing solution or.damping water used on printing thereby to form hydroxyl and carboxyl groups.

* * * * *